United States Patent [19]

Pozzato et al.

[11] 4,043,516

[45] Aug. 23, 1977

[54] DISK MILL FOR MILLING CRUSHING OR GRINDING PEBBLES, GRAVEL, SMALL ROCKS AND THE LIKE

[76] Inventors: Tarcisio Pozzato; Mariano Pozzato; Alberto Pozzato, all of Via Grattacavallo 2, Sandrigo, (Vincenza), Italy

[21] Appl. No.: 669,607

[22] Filed: Mar. 23, 1976

[30] Foreign Application Priority Data

Apr. 4, 1975 Italy ..... 22000/75

[51] Int. Cl.[2] ..... B02C 7/10; B02C 7/14

[52] U.S. Cl. ..... 241/252; 241/253

[58] Field of Search ..... 241/250, 251, 252, 253, 241/254, 257 R, 259, 259.2

[56] References Cited

U.S. PATENT DOCUMENTS

| | | | |
|---|---|---|---|
| 641,654 | 1/1900 | Sturtevant et al. | 241/252 |
| 835,286 | 11/1906 | Menier | 241/253 |
| 1,013,626 | 1/1912 | Symons | 241/252 |
| 1,058,114 | 4/1913 | Symons | 241/252 |
| 1,072,193 | 9/1913 | Symons | 241/252 X |
| 2,947,485 | 8/1960 | Woodruff et al. | 241/259.2 X |
| 3,222,038 | 12/1965 | Ashcraft | 241/253 X |

*Primary Examiner*—Roy Lake
*Assistant Examiner*—Howard N. Goldberg
*Attorney, Agent, or Firm*—Weingarten, Maxham & Schurgin

[57] ABSTRACT

A disk mill having an extended, axially-projecting control arm, for fixing the angular position of the axis of one of the grinding disks of the mill, the free end portion of the control arm engaging a rotary bearing whose position is fixed but adjustable by means of an arrangement comprising a retaining member which has at least a restricted angular movement about a third axis at right angles to the axis of the first grinding disk and which has a translatory movement in a direction parallel to said third axis, the retaining member being connected to the rotary bearing, and a double-acting fluid pressure actuator connected to the retaining member for moving the retaining member in a direction parallel to said third axis.

9 Claims, 5 Drawing Figures

DISK MILL FOR MILLING CRUSHING OR GRINDING PEBBLES, GRAVEL, SMALL ROCKS AND THE LIKE

The present invention relates to a disk mill for milling, crushing or grinding pebbles, gravel, stones (small rocks) and the like, the mill having first and second rotary grinding disks with opposed working faces and drive means for rotating at least one of the grinding disks, the axis of rotation of the second grinding disk being inclinable with respect to the axis of rotation of the first grinding disk and the second grinding disk being fixed to a mount having an extended positional control arm projecting axially thereof for fixing the angular position of the axis of the grinding disk, the free end portion of the control arm engaging a rotary bearing whose position is fixed but adjustable to alter the angular position of the axis of the respective grinding disk.

The actual grinding disks will be present when the mill is operative but may not be present when the mill is manufactured or sold.

Such disk mills are known, and the material is fed between the disks whose rotation causes the material to be thrust towards the zone in which the faces of the disks are closest, at the same time milling, crushing or grinding the material. The inclination of the axes of the disks can be altered, and the distance apart of the disks can be altered, in accordance with the size of the pieces of material fed to the disks, and in accordance with the particle size required for the product.

In one specific construction which has been proposed, a first grinding disk is mounted on a rotary tubular body having a central aperture therethrough, and the control arm controls the second grinding disk and passes along the aperture, the respective mount being itself mounted by means of a part-spherical surface formed adjacent one end of the control arm and engaged in a part-spherical hollow in the end of the tubular body adjacent the first disk. In this arrangement, the grinding disks are, as is usual, annular, and the first grinding disk can be driven whilst the other grinding disk is idle, i.e. freely rotatable but not positively driven, being driven by the forces imparted thereto by the material being ground. The rotary bearing has a restricted universal motion with respect to the free end portion of the control arm, i.e. can be moved with respect thereto about three mutually perpendicular axes, and in addition, the rotary bearing can move axially with respect to the control arm. The rotary bearing is supported in a bearing housing which is in turn fixed to the structure of the mill in such a way that it can be moved in a direction transverse to the axis of the control arm. In order to obtain this adjustment, the bearing housing is secured in position by means of a number of bolts with the interposition of distance pieces such as washers or shims of various thicknesses. However, in order to be able to adjust the inclination of the axis of the second disk, the mill must be stopped for the whole time required for unscrewing the bolts, inserting or removing distance pieces and again screwing up the bolts. In addition, the correct angular position of the axis of the second disk is normally reached after a number of attempts, in each of which the mill is stopped, adjusted and started up again, and if the milling, crushing or grinding is not correct, is again stopped and adjusted. This is an extremely time-consuming procedure. On the other hand, the secure fixing of the rotary bearing ensures that the varying forces applied by the material to the second disk do not cause the disk to undergo substantial oscillations about the centre of its spherical bearing.

OBJECT OF THE INVENTION

The general object of the invention is to provide a disk mill, and parts therefor, in which it is possible to obtain relatively rapid adjustment of the angle between the axes of the grinding disks without necessarily stopping the disk mill, whilst maintaining the relatively firm fixing of the rotary bearing and thus preventing oscillation of the inclinable axis grinding disk.

THE INVENTION

According to the invention, the position of the rotary bearing is adjustably fixed by means of an arrangement comprising a retaining member which has at least a restricted angular movement about a third axis at right angles to but substantially spaced from the axis of the first grinding disk and substantially spaced from the second grinding disk, and which has a translatory movement in a direction parallel to said third axis, the retaining member being connected to the rotary bearing and the rotary bearing permitting some twisting movement between the control arm and the retaining member about an axis parallel to said third axis, and a double-acting fluid pressure actuator connected to the retaining member for moving the retaining member in a direction parallel to said third axis and thereby altering the inclination between the axes of rotation of the grinding disks.

The invention extends to the adjusting and fixing arrangement per se, with the retaining member, rotary bearing, mounting device for the other end of the retaining member, and the actuator.

GENERAL ADVANTAGES OF THE INVENTION

The invention enables the adjustment of the angle between the axes of the two grinding disks to be carried out in a rapid manner using the double-acting actuator, and if the actuator is hydraulic, it can be locked hydraulically. In addition, the rotary bearing means at the free end portion of the control arm can be very securely fixed in position as regards movement laterally of the axis of the control arm, not only in the direction in which the control arm can be tilted for adjustment of the angle between the axes of the grinding disks, but also in the direction at right angles thereto.

Further preferred features and possible advantages of the invention will be apparent from the following description of a preferred embodiment of the invention, given purely by way of example.

DETAILED DESCRIPTION OF PREFERRED EMBODIMENT OF THE INVENTION

Figure 1:
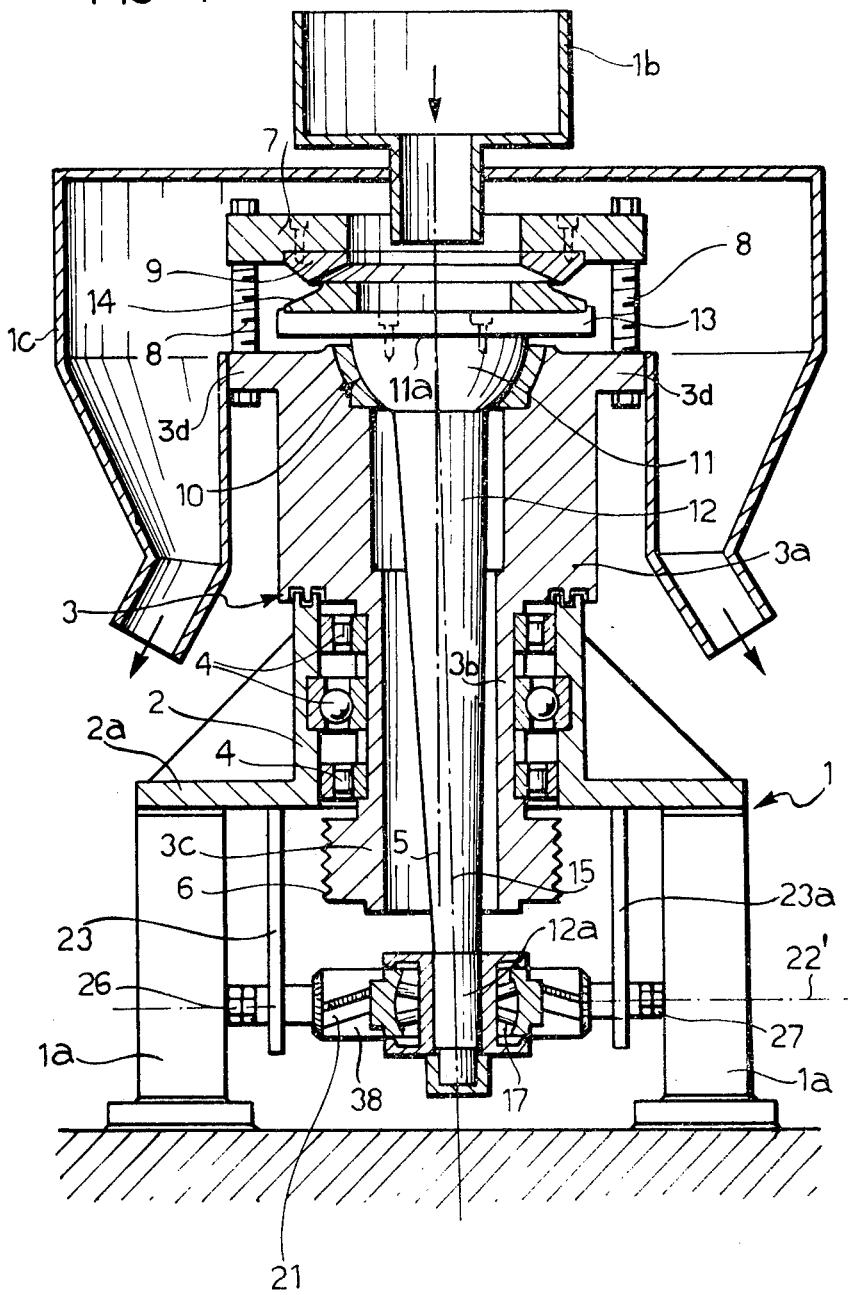
FIG. 1 is a vertical section through a disk mill in accordance with the invention, the section being taken along the line I—I indicated in FIG. 4, some parts being shown schematically.

FIG. 1 shows a disk mill for crushing pebbles to form fine gravel, the mill having a supporting structure 1 which includes a number of columns 1*a* and a cylindrical body 2 having a vertical axis and having a lower flange 2*a* fixed to the tops of the columns 1*a*. A further tubular body 3 is rotatably mounted in the cylindrical body 2, the tubular body 3 having a part 3*a* which extends above the cylindrical body 2 and a part 3*b* which extends down through the cylindrical body 2, anti-friction bearings 4 being interposed between the cylindrical body 2 and the part 3*b*. The cylindrical body 2 and the tubular body 3 have a common axis 5, referred to herein as the first axis. The lowermost part 3*c* carries a coaxial pulley 6 below the level of the flange 2*a*, the pulley 6 forming drive means for rotating the tubular body 3 and being positively driven by a conventional belt drive (not shown).

The top of the part 3*a* of the tubular body 3 is provided with a flange 3*d* which in turn supports a first annular mount 7 by means of a number of adjustable, screw-threaded supports 8. A first grinding disk 9 is fixed coaxially to the mount 7 in any suitable conventional manner, the working face of the disk 9 being lowermost.

The top of the part 3*a* of the tubular body 3 carries a coaxial seating member 10 which defines an annular part-spherical hollow or seat, facing upwards. A part-spherical head 11, formed at the upper end of a position control arm 12, rests within the seat in such a way that it can swivel about the centre of the sphere, which is on the axis 5. A circular second mount 13 is fixed in any suitable manner to the flat top surface 11*a* of the head 11, and a second grinding disk 14 is fixed to the mount 13 in any suitable manner, the working surface of the second disk 14 being uppermost and opposed to that of the grinding disk 9.

The control arm 12 is thus fixed to the second mount 13 and projects downwards along the axis 15 (referred to as the second axis) of the second mount 13 and down through the central aperture through the tubular body 3. The control arm 12 is tapered in such a way that it can have its axis 15 inclined relative to the first axis 5 in order to incline the second grinding disk 14 relative to the first grinding disk 9.

An inlet hopper 1*b* for the supply of material to the space between the grinding disks 9, 14, and a discharge hopper 1*c* for the discharge of the crushed material, are indicated in FIG. 1, these items being conventional items.

Figure 2:
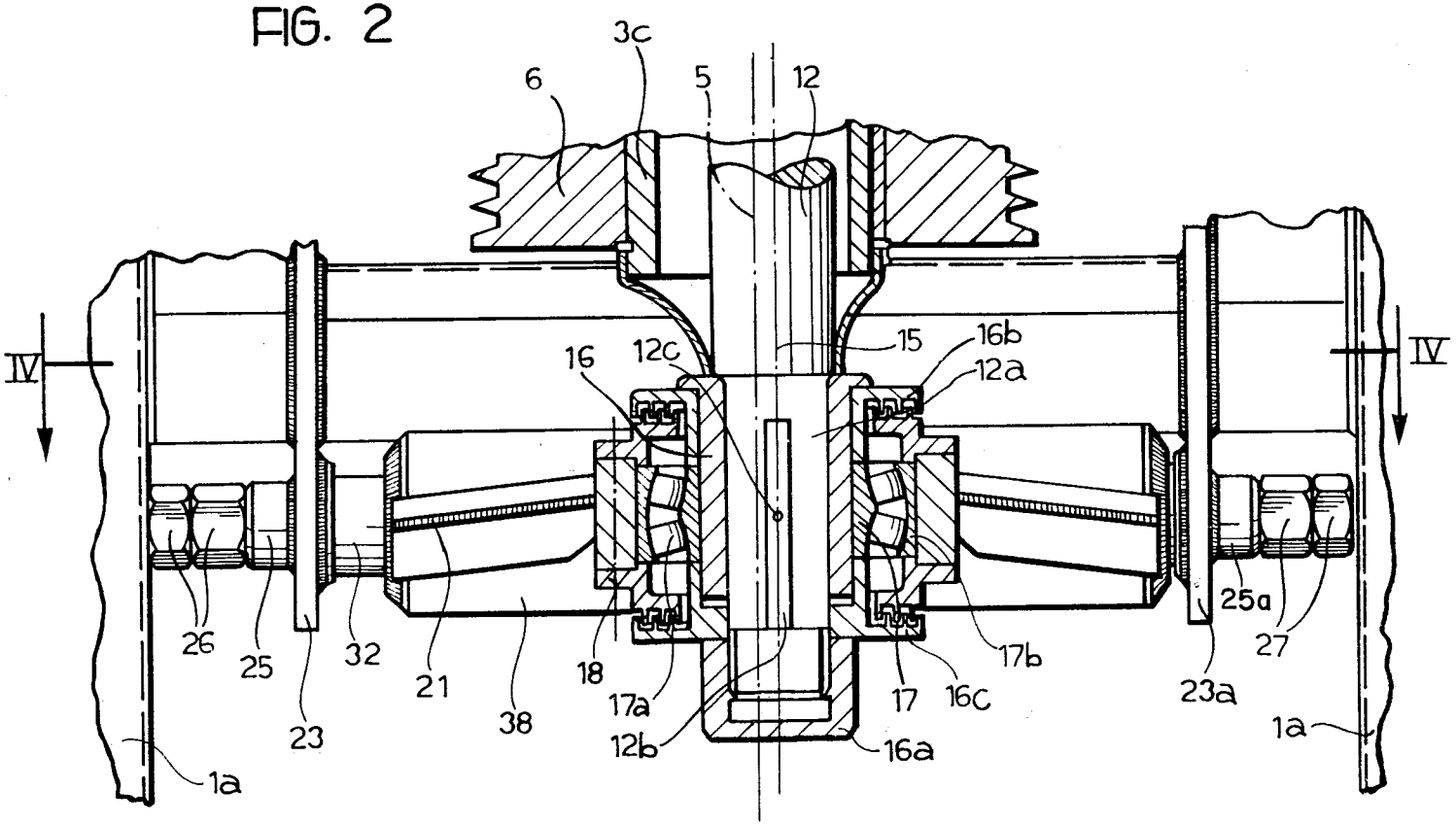
FIG. 2 corresponds generally to FIG. 1, but shows a part thereof on an enlarged scale.

As shown more clearly in FIG. 2, the lower end portion 12*a* of the control arm 12 projects below the part 3*c* of the tubular body 3. A sleeve 16 is rotationally fixed to the lower end portion 12*a* by means of a conventional key 12*b* which is carried in a slot in the periphery of the portion 12*a* and pinned in position by a small dowel 12*c*, but the sleeve 16 can be withdrawn downwards when a retaining cap 16*a* is removed. The retaining cap 16*a* not only holds the sleeve 16 in position but also retains an inner race 17 of a radial thrust antifriction bearing and two spacers 16*b* and 16*c*. The rotary bearing has rollers 17*a* and an outer race 17*b* secured in a housing 18, and the arrangement is such that the housing 18 can rotate with respect to the control arm 12 and can also twist with respect to the second axis 15 about two mutually perpendicular axes which are both normal to the axis 15.

Figure 3:
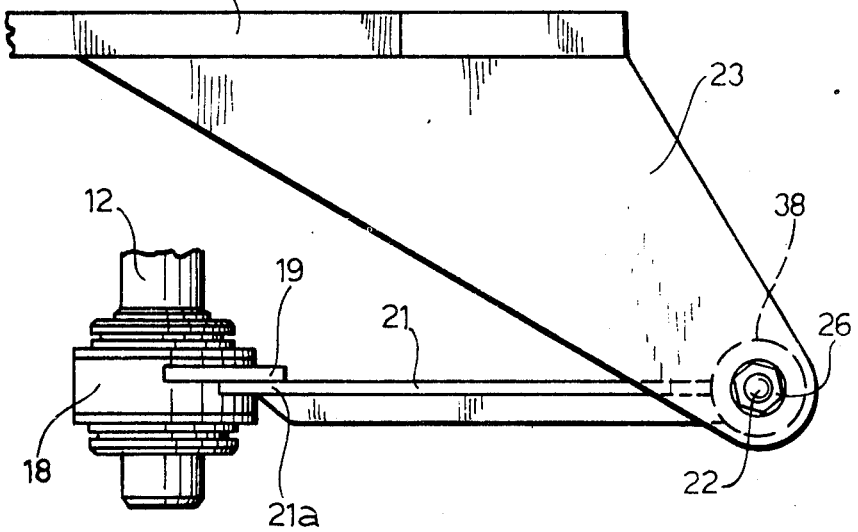
FIG. 3 is a side view of the part shown in FIG. 2, but on a somewhat smaller scale.
Figure 4:
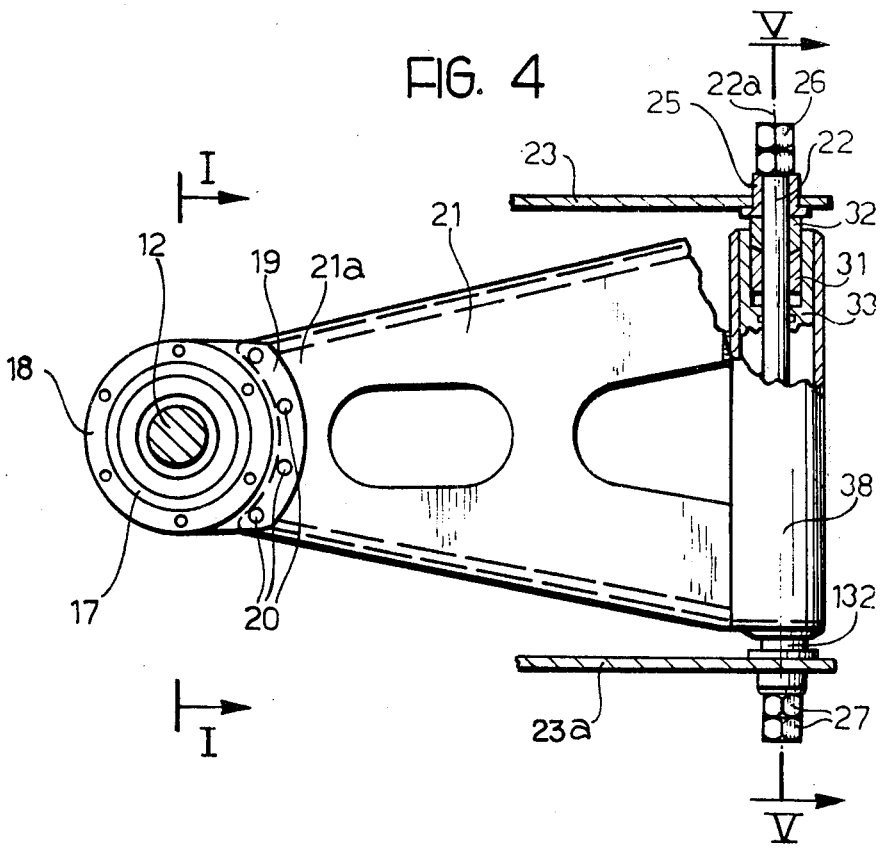
FIG. 4 is a section along the line IV—IV in FIG. 2, but on the same scale as FIG. 3.

As can be seen more clearly in FIGS. 3 and 4, the housing 18 has a coaxial, part-annular flange 19 which is fixed by means of a number of bolts or screws 20 to one end 21*a* of a retaining member in the form of a plate 21 projecting from and supported by a mounting device which includes a pivot member in the form of a circular-section bar 22 in a manner described in more detail below. The pivot bar 22 is fixed in position by means of two parallel brackets 23, 23*a* which are fixed to and project downwards from the flange 2*a* on the cylindrical body 2, in such a way that the axis 22' (referred to herein as the third axis) of the bar 22 is at right angles to, but substantially spaced from, the second axis 15, and is substantially spaced from the first and second mounts 7, 13.

Figure 5:
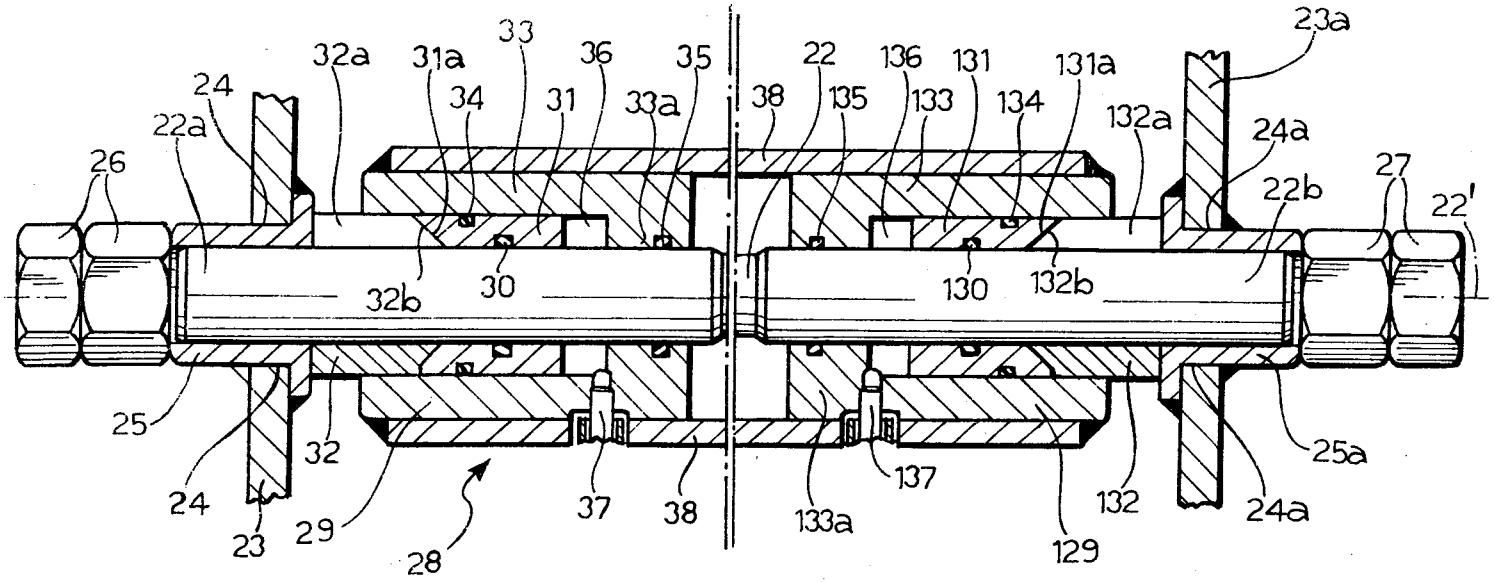
FIG. 5 is a section along the line V—V in FIG. 4, but on a larger scale than FIG. 2.

Referring particularly to FIG. 5, the brackets 23, 23*a* each have an aperture 24, 24*a* in which is fixed a respective coaxial bushings 25, 25*a*. The end portions 22*a*, 22*b* of the pivot bar 22 are received in the bushings 25, 25*a*, and the end portions 22*a*, 22*b* have threaded terminal portions (not visible in FIG. 5) which project beyond the bushings 25, 25*a* and carry lock-nuts 26, 27.

A double-acting, linear pressure fluid actuator 28 is coaxially and rotatably mounted on the pivot bar 22 between the brackets 23, 23*a*, the actuator 28 having a fixed or stationary part and a movable part which is movable along the third axis 22', as is described in more detail below. The actuator 28 consists essentially of two identical piston-cylindrical units or rams 29, 129 which are mounted on the pivot bar 22 and are symmetrical about the centre of the bar 22. In the following description, only one ram 29 is described, but the parts of the other ram 129 are the same, the references being increased by 100.

An annular piston 31 surrounds and is slidably mounted on the bar 22, being sealed thereto by an O-ring 30; the rear face 31*a* of the annular piston 31, i.e. the face which is nearer the bushing 24, is concave and in the shape of a truncated cone. The piston 31 is spaced from the bushing 24 by a split bushing 32 mounted coaxially on the bar 22 and having an external diameter equal to the diameter of the piston 31. The split bushing 32 has a gap 32*a* in its transverse section, extending for the whole length of the split bushing 32, and its front face 32*b* is in the shape of a truncated cone for mating with the rear face 31*a* of the piston 31.

The ram 29 has a cylinder which is formed by a cup-shaped member 33 which is slidably and rotatably mounted on the pivot bar 22, the pivot bar 22 passing through a hole 33*a* in its base. The cup-shaped member 33 is sealed to the piston 31 and to the bar 22 by means of respective O-rings 34, 35. A pressure fluid chamber 36 is formed between the base 33*a* of the cup-shaped member 33 and the piston 31 and a connection 37 is provided for connecting the pressure fluid chamber with a supply and return of pressure fluid (not shown).

A sleeve 38 is fixed, for instance by welding, to the cup-shaped members 33, 133, which form the movable part of the actuator 22, the actuator 28 being in this manner disposed between the pivot bar 22 and the sleeve 38. The respective end of the retaining plate 21 is fixed to and made rigid with the sleeve 38, for instance by welding, and in this way the retaining plate 21 has only one freedom of translatory movement, namely movement parallel to the third axis 22', and only one freedom of rotary movement, namely a restricted movement about the third axis 22', the retaining plate 21 being moved in a direction parallel to the third axis 22' by the actuator 28. When the angle between the first axis 5 (of the grinding disk 9) and the second axis 15 (of the grinding disk 14) is to be varied, the position control arm 12 must be tilted correspondingly with respect to the first axis 5. For this purpose, the actuator 28 is utilized to move the retaining plate 21 in the appropriate horizontal direction and through a distance corresponding to the desired alteration in the angle of the second axis 15. For example, in order to move the second axis 15 in an anticlockwise direction relative to the first axis 5, as seen in FIG. 1, the retaining plate 21 must be moved to the right, as seen in FIG. 5. In order to perform this movement, pressure fluid is supplied to the pressure fluid chamber 36 through the connection 37 and pressure fluid is released from the pressure fluid chamber 136 through the connection 137, the unit formed by the two cup-shaped members 33, 133, the sleeve 38 and the retaining plate 21 thereby moving to the right. When the desired displacement has been achieved, the connections 37 and 137 are blocked off in any conventional manner, for instance using a closed centre spool valve (not shown). In this way, the actuator 28 is locked in its new position by the pressure fluid in the chambers 36, 136, and in order to achieve rigid locking, it is preferred to use a hydraulic pressure fluid.

It will be seen that the pressure fluid forces the rear faces 31*a*, 131*a* of the piston 31, 131 against the front faces 32*b*, 132*b* of the split bushings 32, 132, thereby forcing the split bushings 31, 132 to grip the pivot bar 22 and transmitting the force to the bar 22 without excessively loading the respective lock nuts 26, 27 by way of the respective bushing 25, 25*a*.

If the second axis 15 is to be tilted in the opposite direction, the actuator 28 is moved in the opposite sense, pressure fluid being supplied to the pressure fluid chamber 136 and discharged from the pressure fluid chamber 36.

The arrangement enables the inclination of the grinding disk 14 relative to the grinding disk 9 to be altered while the mill is operative. In this way, the inclination can be adjusted continuously, immediately upon visual examination of the crushed material being discharged from the mill, without having to stop the mill. Furthermore, the distance between the second axis 15 and the third axis 22' is fixed by the retaining plate 21, and thus the control arm 12 cannot oscillate substantially in the direction of the line joining the axes 15 and 22', and at the same time, although the retaining plate 21 can be translated in a direction parallel to the third axis 22', it cannot pivot about a vertical axis intersecting the third axis 22', thereby preventing oscillation of the control arm 12 in a direction parallel to the third axis 22' once the actuator 28 has been locked.

In addition, the use of a double-acting hydraulic actuator 28 which can be hydraulically locked in position avoids any play which could occur for instance with a spindle-and-nut adjustment, while enabling rapid adjustment to be performed.

As disclosed in copending U.S. patent application Ser. No. 661,327 in the name of Pozzato et al., the axial distance between the seating member 10 and the cylindrical body 2 may be variable, to vary the distance between the grinding disks 9, 14, and the arrangement described above allows the control arm 12 to execute the corresponding axial movement, in that the housing 18 of the anti-friction bearing 17, 17*a*, 17*b* can be tilted with respect to the axis 15 of the control arm 12 about horizontal axes perpendicular to the axis 15, and in that the retaining plate 21 can in turn rotate somewhat about the third axis 22', the cup-shaped members 33, 133, and thus the sleeve 38, being freely rotatable about the pivot bar 22 and pistons 31, 131.

The invention extends to the control parts per se, that is to say to the arrangement of the pivot or pivot bar 22, the actuator 28 and the connecting member or connecting plate 21 and associated rotary bearing 17.

We claim:

1. A disk mill for milling, crushing or grinding pebbles, gravel, small rocks and the like, the mill comprising:

a support structure;

a first mount for mounting a first grinding disk having a working face;

first rotary mounting means rotatably mounting the first mount with respect to the support structure for rotation about a first axis;

a second mount for mounting a second grinding disk having a working face opposing the working face of the first grinding disk;

second rotary mounting means rotatably mounting the second mount with respect to the support structure and with respect to the first mount, for permitting the second mount to rotate about a second axis, the second rotary mounting means also permitting said second axis to be inclined relative to said first axis;

an extended control arm fixed to the second mount and projecting along said second axis;

a retaining member;

means mounting the retaining member for at least a restricted angular movement about a third axis at right angles to but substantially spaced from said first axis and substantially spaced from the second mount, and for translatory movement in a direction parallel to said third axis;

rotary bearing means connecting the retaining member to the control arm at a position substantially spaced from the second mount, which rotary bearing means permits the control arm to rotate about said second axis with respect to the retaining member and permits some twisting movement between the control arm and the retaining member about an axis parallel to the third axis;

a double-acting fluid pressure actuator having a stationary part connected to the support structure of the mill and a movable part connected to the retaining member, for alternating the inclination of said second axis relative to said first axis; and drive means for positively rotating at least one of the first and second mounts.

2. The disk mill according to claim 1, wherein said mounting means mounting the retaining member comprises a pivot member whose axis is fixed and coincident with said third axis and a sleeve mounted thereon for translatory movement along the pivot member and at least a restricted rotational movement with respect to the pivot member, the retaining member being rigid with the sleeve.

3. The disk mill according to claim 2, wherein the fluid pressure actuator is a linear actuator disposed between the pivot member and the sleeve.

4. The disk mill according to claim 1, wherein the fluid pressure actuator is a linear actuator comprising said stationary part connected to the support structure of the mill, said movable part moves parallel to said third axis, the retaining member being rigid with the movable part of the linear actuator at least in a translatory sense.

5. The disk mill according to claim 4, wherein said movable part of the linear actuator has at least a restricted angular movement about said third axis, the connecting member being rigid with said movable part.

6. The disk mill according to claim 4, wherein the stationary part of the linear actuator is connected to the support structure of the mill by means of a fixed pivot member whose axis is coincident with said third axis, the linear actuator comprising two spaced cup-shaped members having bases which face one another, the pivot member passing through holes in the bases and the cup-shaped members sliding on the pivot member, sealing means sealing the bases to the pivot, an annular piston contained in each cup-shaped member, surrounding the pivot member and slidable with respect to the cup-shaped member, thereby forming a pressure fluid chamber between the base of the cup-shaped member and the respective face of the piston, the opposite face of the piston being supported by the supporting structure of the mill, and connector means being adapted for supplying pressure fluid to, and returning pressure fluid from, the pressure fluid chambers.

7. The disk mill according to claim 6, wherein each annular piston of the linear actuator can slide on the pivot member, said opposite face of each annular piston has a truncated-conical recess therein and engages a split bushing surrounding the pivot member, which split bushing has a truncated-conical face mating with said opposite face of the piston, is elastically deformable in the circumferential sense, and has a gap in its periphery so that the back pressure of the piston forces the split bushing to grip the pivot member, thereby locking the split bushing in position.

8. The disk mill according to claim 6, wherein each annular piston of the linear actuator can slide on the pivot member.

9. The disk mill according to claim 1, wherein the first rotary mounting means comprises a tubular body defining a central aperture therethrough, the control arm passes along the aperture, and the second rotary mounting means comprises an annular, part-spherical hollow defined in said tubular body adjacent the first mount, the center of the sphere being on said first and second axes, and an annular, part-spherical surface formed adjacent one end of said control member and engaged in the part-spherical hollow.

* * * * *